United States Patent [19]

Loire

[11] Patent Number: 4,662,790

[45] Date of Patent: May 5, 1987

[54] ARRESTOR FOR LARGE DRIFTING OBJECTS

[75] Inventor: René Loire, San Francisco, Calif.

[73] Assignee: Morrison-Knudsen Company, Inc., Boise, Id.

[21] Appl. No.: 748,011

[22] Filed: Jun. 24, 1985

Related U.S. Application Data

[63] Continuation of Ser. No. 545,959, Oct. 27, 1983, abandoned.

[51] Int. Cl.[4] ..... E02B 3/22

[52] U.S. Cl. ..... 405/212; 405/211; 114/219

[58] Field of Search ..... 405/200, 205, 211, 212, 405/215–217, 61, 201; 114/40–42, 219; 267/139, 140, 141, 141.1

[56] References Cited

U.S. PATENT DOCUMENTS

| | | | |
|---|---|---|---|
| 3,672,175 | 6/1972 | Mason | 405/211 |
| 3,901,040 | 8/1975 | Sandberg | 405/212 |
| 4,102,144 | 7/1978 | Anders | 405/217 X |
| 4,215,952 | 8/1980 | Baardsen | 405/211 |
| 4,295,758 | 10/1981 | Yashima | 405/211 X |
| 4,422,804 | 12/1983 | Gerwick et al. | 405/211 X |
| 4,433,941 | 2/1984 | Gerwick et al. | 405/211 |
| 4,437,793 | 3/1984 | Meny | 405/212 |
| 4,446,806 | 5/1984 | Loire | 405/212 X |

FOREIGN PATENT DOCUMENTS

| | | | |
|---|---|---|---|
| 844674 | 7/1981 | U.S.S.R. | 405/211 |

*Primary Examiner*—Cornelius J. Husar
*Assistant Examiner*—Nancy J. Stodola
*Attorney, Agent, or Firm*—Walter J. Blenko, Jr.

[57] ABSTRACT

An arrestor for reducing the velocity of moving icebergs and the like or large drifting objects relative to an off-shore fixed structure is disclosed. In use, the device extends outwardly from a fixed structure in at least one direction. A frame is adapted to be mounted to the structure in a manner which will allow an extending end thereof to move toward the structure. Nylon ropes or any other suitable elastic members are attached to the frame and to the structure and are utilized to provide an increasingly greater resistive force on the frame as the extending end of the frame is pushed toward the structure by an iceberg. Various embodiments of the general concept are disclosed.

10 Claims, 8 Drawing Figures

ARRESTOR FOR LARGE DRIFTING OBJECTS

This is a continuation of application Ser. No. 545,959 filed Oct. 27, 1983 now abandoned.

This invention relates to an arrestor for reducing the velocity of moving icebergs, ice islands, floes and the like or any large drifting object relative to a fixed marine structure. More specifically, elastic means, such as nylon ropes, connected to the structure, and to a barrier means such as a frame member movably mounted to the structure, provide an increasingly greater resistive force on the frame as the frame is pushed toward the structure by an iceberg A major problem with off-shore drilling and production structures which are located in "iceberg alleys" such as the Hibernia field off Newfoundland is the extensive damage which may be caused by icebergs. The only known structure which can directly resist the impact of a major iceberg is a large rubble mound which resists the mass of the iceberg with its own mass.

To protect gravity concrete structures of the type used in the North Sea, it has been proposed to install a heavy ring founded on the base of the concrete structure. When impacted by an iceberg, the ring is displaced horizontally and the energy generated by friction on the base is intended to dissipate the kinetic energy of the drifting iceberg. However, the reaction of the iceberg thrust is theoretically constant during the displacement of the ring and the structure must survive a considerable initial shock. An effective fendering system, on the other hand, should provide a progressively increasing resistive force which rises from zero at first contact to a maximum when the object is finally arrested.

I provide an arresting system for reducing the velocity of moving icebergs and the like relative to a fixed structure based on the stretching of nylon ropes or other suitable elastic means.

I prefer to provide a barrier means such as a frame adapted to be movably mounted to a fixed off-shore structure in a manner which will allow movement of an outwardly extending portion of the frame toward the structure. I prefer to provide an elastic means, such as nylon ropes, adapted to be connected to both the frame and the structure for applying an increasingly greater resisting force on the frame as the frame, upon contact with and under the force of a moving iceberg or the like, moves toward the structure. I prefer to provide a frame which extends outwardly from a fixed structure in a horizontal direction.

In some instances I may prefer to provide a barrier means which is buoyant whereas in some instances, I prefer to provide a barrier means which is ballasted to lie beneath the sea surface on a suitable subsurface support or held beneath the ice surface by some other means, such as outriggers.

I may provide a barrier means which is mounted for rotation about the fixed structure. I may provide an arrestor having means attached to the barrier means for rotating the barrier means about the structure to a desired position.

I prefer to provide an arrestor having at least one open-ended tube extending from the barrier means for engaging an iceberg. Should the arrestor be primarily intended to protect a structure, for example a bridge pier, against drifting or poorly controlled ships, the barrier would be rounded or shaped to deviate the blow.

In the accompanying drawings, I have illustrated certain present preferred embodiments of my invention in which.

Figure 1:
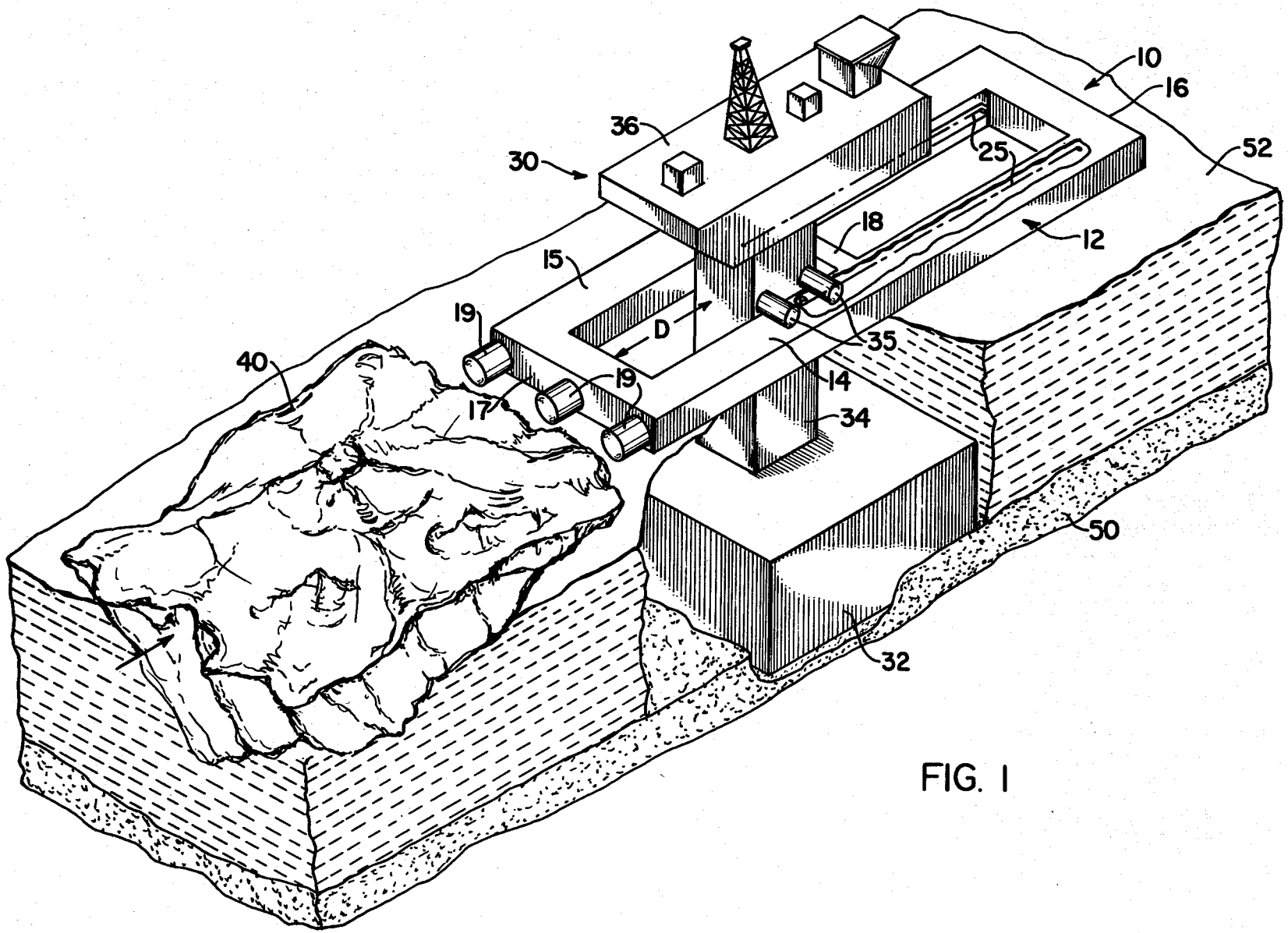
FIG. 1 is an isometric view of a preferred embodiment of the present invention showing a unidirectional ice arrestor having a buoyant frame.
Figure 2:
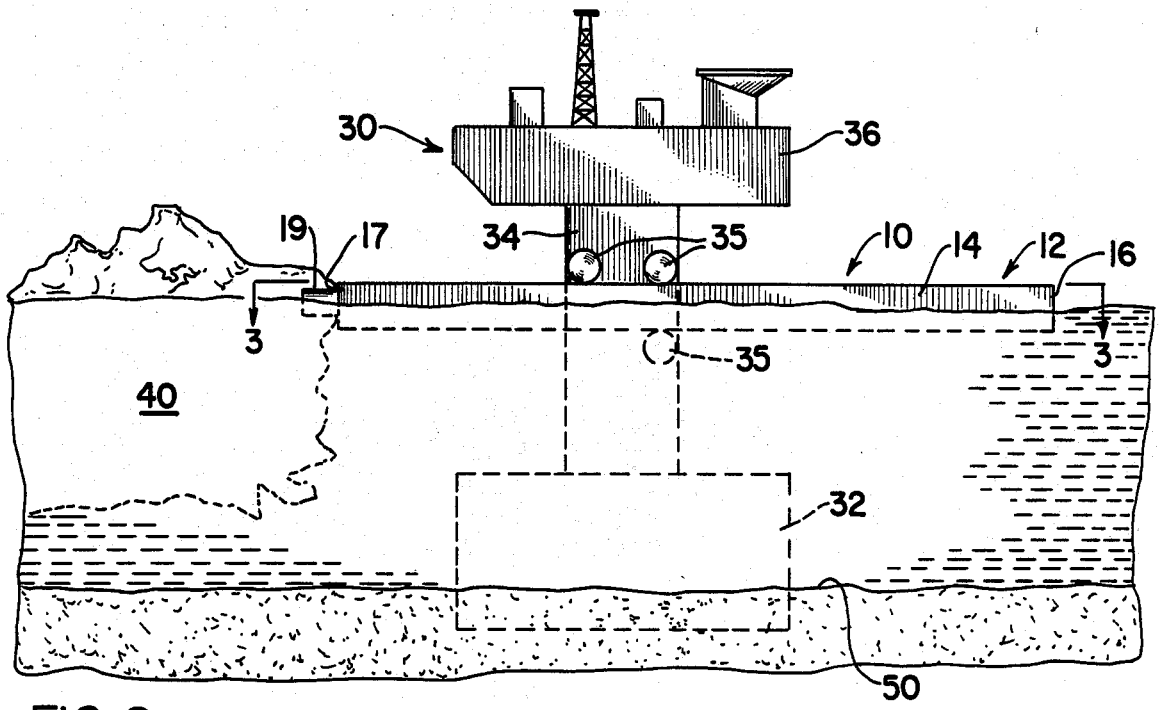
FIG. 2 is a side-elevational view of the ice arrestor shown in FIG. 1.
Figure 3:
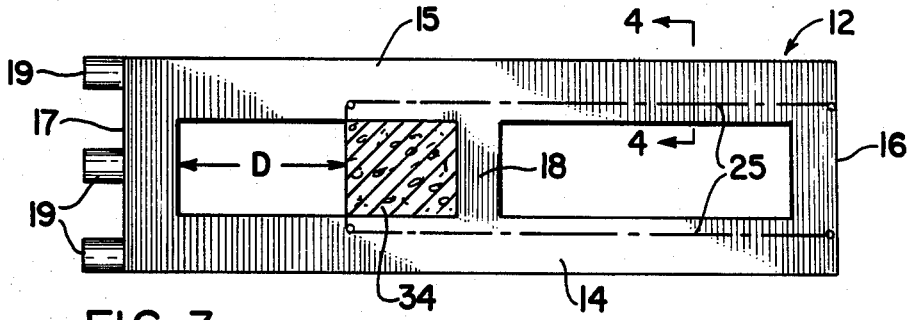
FIG. 3 is a longitudinal cross-sectional view of the arrestor taken on the line III—III of FIG. 2.

FIGS. 1 through 3 show a unidirection buoyant arrestor. The arrestor 10 is utilized to protect off-shore drilling and production structures, such as structure 30, from damage caused by drifting icebergs 40 or the like. Structure 30 has a base 32 which is embedded into sea floor 50 and has a vertical oriented shaft 34 attached to base 32 and extending upwardly therefrom. Shaft 34 has a generally rectangular cross-sectional configuration and extends upwardly to a point above sea surface 52 as shown. A platform member 36 is provided on the upper end of shaft 34.

The arrestor 10 is comprised of a barrier means which in this instance is a generally rectangular floating frame member 12 and one or more nylon ropes or lines 25. Frame 12 has longitudinally extending side portions 14 and 15, a rear end portion 16 and a front end portion 17. Side portions 14 and 15 have a generally "C" shaped transverse cross-sectional configuration and have recesses therein for receiving the nylon rope or lines 25. Ropes 25 are attached at one end thereof to end 16 of frame member 12 and the other end thereof to shaft 34. In some locations it may be necessary to provide a buoyant collar member around shaft 34 to which said nylon ropes are attached, rather than directly attaching the ropes to the shaft, so that the frame and collar may lift upwardly on the shaft 34 as required by changes in ocean tide. When the arrestor is intended for protection against large drifting ice features, one or more open ended tube members 19 are attached to front end 17 of arrestor 10 for engaging oncoming ice 40. Upon impact, the frame 12 moves backwardly and stretches the bundle of nylon ropes 25. The length of the ropes will initially be about four times the expected elongation at fifty percent of breaking strength. The nylon ropes 25 initially hold frame member 12 into position by pulling it against cross-frame member 18 as shown. Frame 12 may move backwardly a distance D which is equal to the preferred maximum elongation of the nylon ropes. Practically, D will be between thirty and fifty meters to enable the system to stop a multi-million ton iceberg drifting at one or two knots.

The energy of the iceberg 40 is dissipated by stretching the nylon ropes 25, by the friction of frame 12 on the well shaft or column 34 of the structure, and to a smaller extent, by bending of the frame mebers Vertical stops 35, outrigging from the shaft 34, above and under the frame 12, prevent the frame from tilting in a vertical plane rather than fully stretching the ropes. Tilting is further resisted by holding pins or tubes 19 which penetrate the iceberg.

The above-described unidirectional arrestor is designed to protect drilling structures from oncoming icebergs and the like which approach off-shore structures within an angle of 60° or larger. It could also be used to protect bridge piers in turbulent waters.

Figure 4:
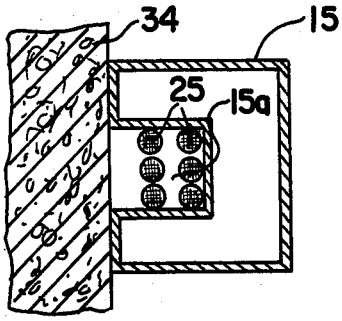
FIG. 4 is a transverse cross-sectional view of a portion of the arrestor frame taken on the line IV—IV of FIG. 3.

FIG. 4 shows the generally "C" shaped cross-sectional configuration of frame member 14 As shown, frame member 15 is formed to have a recess 15*a* therein for receiving the nylon ropes or lines 25. Frame member 15 is positioned so that a portion of its length contacts a wall portion of shaft 34.

Figure 5:
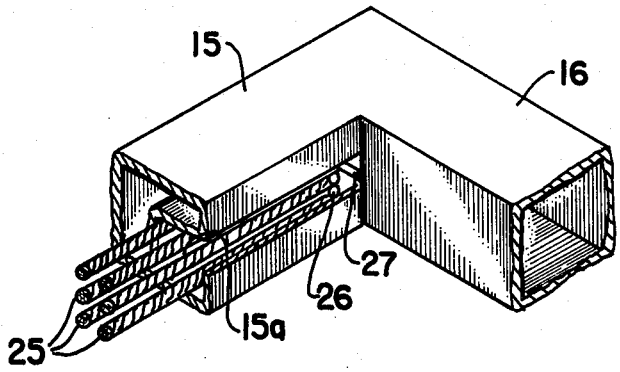
FIG. 5 is a fragmentary view of a rearmost corner of the arrestor frame shown in FIG. 1.

FIG. 5 is a fragmentary view of the juncture of frame members 15 and 16 showing the general construction thereof. Frame member 16 has a generally square and hollow cross-sectional configuration. Frame member 15, as mentioned, has a generally "C" shaped transverse cross-sectional configuration presenting a recess 15*a* through which nylon ropes or lines 25 may pass. One end 26 of ropes 25 is attached to an anchor 27 provided near the juncture of members 15 and 16. Likewise, on the other side of the frame member 12 near the juncture of frame members 15 and 16, one end of additional nylon ropes 25 (not shown) is attached to a similar anchor. The opposite ends of ropes 25 are attached to side portions of shaft 34 by any suitable means.

In the embodiment of the invention shown in FIGS. 1 through 5, frame member 12 serves as the barrier means and has at least one end thereof, end 17, which extends horizontally outwardly from the off-shore fixed shaft 34. Although nylon ropes are preferred, any suitable elastic means may be utilized to connect the frame member to the well shaft 34 for applying an increasingly greater resistive force on the frame as the frame moves toward the shaft 34.

Figure 6:
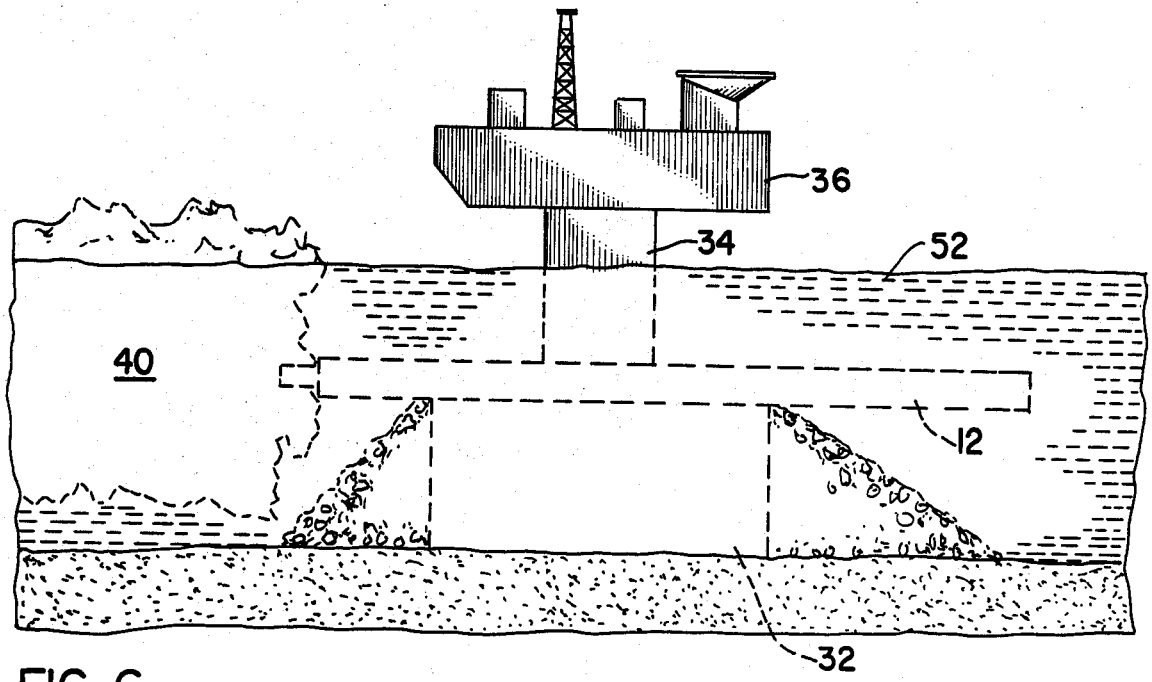
FIG. 6 is a side-elevational view of another embodiment of the present invention showing an arrestor having a frame thereon ballasted to lie beneath the sea surface on a suitable subsurface support.

FIG. 6 shows a subsea ice arrestor. Structurally, this embodiment of the invention is nearly identical to the embodiment shown in the previous figures. This arrestor, however, is provided with a suitable ballast on frame 12 so that the frame will lie some distance beneath the sea surface 52 in order to minimize wave action on the arrestor. Preferably, frame 12 is ballasted so that it rests on base 32 or on any suitable subsea supporting means. Maintenance and replacement of ropes is performed by refloating the frame to the surface.

Figure 7:
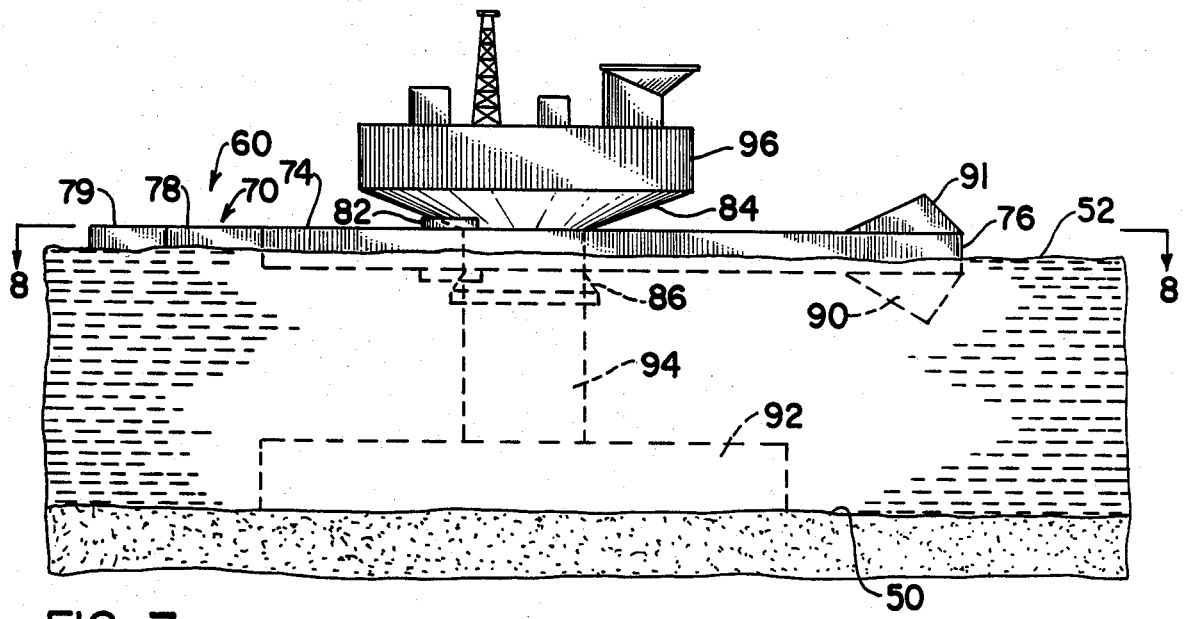
FIG. 7 is a side-elevational view of yet another embodiment of the present invention showing a pivotable arrestor.
Figure 8:
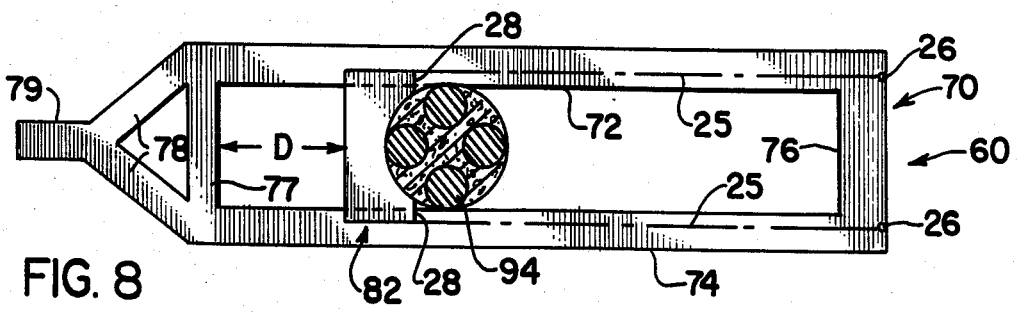
FIG. 8 is a longitudinal cross-sectional view of a pivotable arrestor taken on the line VIII—VIII of FIG. 7.

FIGS. 7 and 8 show a pivotable iceberg arrestor 60. Arrestor 60 comprises a barrier means in the form of a generally rectangular floating frame member 70, one or more nylon ropes or lines 25 and a collar member 82 having a semi-circular cut-out therein sized to receive an off-shore fixed circular shaft. Frame member 60 has longitudinally extending side portions 72 and 74, a transversely extending rear portion 76, a transversely extending front portion 77 and an outwardly extending pike portion 79. Pike portion 79 is preferably fabricated from open ended tubing and may be attached to forward end 77 of frame 70 either directly or by any suitable cross member means 78. Longitudinally extending members 72 and 74 have generally "C" shaped transverse cross-sectional configurations presenting recesses through which the nylon ropes 25 may freely pass. Upstream ends 28 of nylon rope 25 are attached to the semi-circular collar and the downstream ends 26 of ropes 25 are attached to frame member 76. Frame 70 of arrestor 60 is designed to rotate about a circular shaft 94 which extends downwardly to a fixed base 92 and upwardly above sea level to a platform 96. Cones 84 and 86, or any other suitable outrigging structures, are provided above and below frame member 70 to prevent the frame from vertical tilting. As mentioned, the upstream end 77 of frame 70 is fitted with an open ended tube 79 which acts as a pike and penetrates the iceberg upon impact therewith. Such penetration will also prevent the frame from tilting, since most icebergs are much too heavy to be lifted by the pike.

Pike 79 of frame 70 is oriented to point in an upstream direction by the action of wind or ocean current on surface fin 91 and subsea fin 90. It is contemplated, however, that various other rotating means could be utilized to rotate the frame relative to the shaft to a desired position.

Whenever an iceberg is very heavy and wide, it will not be deviated after meeting the pike 79 and will push frame 70 directly toward fixed shaft 94, thus stretching nylon ropes 25 in a direction parallel to the current or wind (whichever is predominant). The iceberg may exert a force on the frame up to the maximum load for which the structure is designed. I prefer to provide an arrestor which will allow the ropes to stretch only to fifty percent of their breaking strength and then, if required, cause the frame to be stopped by the main structural shaft. When an iceberg is relatively small, on the other hand, it may be rotated by the arrestor and deviated away from the structure without stretching the ropes to the limit. In both cases, a full and direct impact on the structure is avoided. It is still further contemplated that a suitable power rotating means could be utilized to divert even the largest ice feature away from a direct impact on the structure.

Use of the pivotable ice breaking arrestor is preferred when ice can be expected to drift toward an off-shore structure from any direction.

It is to be understood that while I have described each of the above embodiments of the present invention as utilizing one or more nylon ropes or lines, that polyethylene or polypropylene ropes or any other suitable elastic means may be utilized. The use of nylon is preferred because a nylon rope, when stretched to half-breaking strength, is elongated by approximately twenty-five percent thus making it well suited for use in this context. The energy developed in that process is about 2/5 $F \times D$ where F is the streching force, and D the related elongation. It is to be further understood that while I have described a frame member as the barrier means that any suitable member attached to the structure could serve the function of the barrier means.

While I have illustrated and described certain present preferred embodiments of the invention, it is to be understood that the invention is not limited thereto and may be otherwise variously practiced within the scope of the following claims.

I claim:

1. An arrestor for reducing the velocity of objects drifting in the ocean relative to an offshore fixed marine structure comprising:

(a) barrier means movably mounted to the structure and having a front end with a front outwardly extending portion which is positioned to make contact with an object drifting in the ocean, a rear portion, and two side portions with one side portion positioned on the opposite side of the structure from the other side portion and, with each side portion extending between and connecting said front end to the rear portion, said barrier means being mounted upon the structure in a horizontal plane which is generally parallel to the surface of the ocean, said front outwardly extending portion being movable at least toward the structure when said rear portion moves away from the structure and away from the structure when said rear portion moves toward the structure, said barrier means being characterized by direct connection only to the marine structure and by connection to the sea bottom only through the marine structure;

(b) elastic force transmission means connected to the structure and at least one point of said barrier means which is located between the structure and the rear of the frame, said elastic means yieldingly resisting movement of the barrier means from force applied by a drifting object in contact with said barrier means by said elastic means elongating when said front outwardly extending portion moves toward the structure, thereby transmitting force of the drifting object against the barrier means to the structure while allowing movement of the barrier means and drifting object relative to the structure, said elastic means transmitting force to the barrier means which resists force applied to the barrier means by the drifting object; and (c) barrier stop means mounted on the structure and in engagement with said barrier means and blocking tilting movement of said barrier means out of a horizontal plane.

2. An arrestor according to claim 1 wherein the barrier means is adapted to extend outwardly from the fixed structure in a horizontal direction.

3. An arrestor according to claim 1 wherein said barrier means is buoyant.

4. An arrestor according to claim 1 also comprising a ballast attached to said barrier means.

5. An arrestor according to claim 1 wherein said barrier means is adapted to be mounted for rotation about said fixed structure.

6. An arrestor according to claim 5 further comprising means connected to the barrier means for rotating the barrier means relative to the structure to a desired position.

7. An arrestor according to claim 6 wherein said rotating means is a surface and subsea fin.

8. An arrestor according to claim 1 also comprising at least one open ended tube extending from the barrier means for engaging icebergs and the like.

9. An arrestor according to claim 1 wherein said elastic means are nylon ropes.

10. An arrestor according to claim 1 wherein said barrier means is a frame.

* * * * *